US006394371B1

(12) United States Patent
Ribardi

(10) Patent No.: US 6,394,371 B1
(45) Date of Patent: May 28, 2002

(54) CLOSED-LOOP CYCLONIC MILL, AND METHOD AND APPARATUS FOR FIBERIZING MATERIAL UTILIZING SAME

(75) Inventor: Harris J. Ribardi, Metairie, LA (US)

(73) Assignee: Superior Technologies LLC, Belle Chasse, LA (US)

( * ) Notice: Subject to any disclaimer, the term of this patent is extended or adjusted under 35 U.S.C. 154(b) by 0 days.

(21) Appl. No.: 09/413,835

(22) Filed: Oct. 6, 1999

Related U.S. Application Data

(63) Continuation-in-part of application No. 09/099,925, filed on Jun. 19, 1998, now abandoned.

(51) Int. Cl.[7] ..... B02C 19/06

(52) U.S. Cl. ..... 241/5; 241/16; 241/19; 241/39; 241/79.1

(58) Field of Search ..... 241/5, 39, 16, 241/19, 79.1

(56) References Cited

U.S. PATENT DOCUMENTS

| | | | | |
|---|---|---|---|---|
| 1,575,717 A | | 3/1926 | Plauson | |
| 3,255,793 A | | 6/1966 | Clute | |
| 3,595,486 A | * | 7/1971 | Stephanoff | 241/5 |
| 3,800,429 A | | 4/1974 | Lindl | |
| 3,937,405 A | * | 2/1976 | Stephanoff | 241/39 |
| 3,958,342 A | | 5/1976 | Stephanoff | |
| 4,055,307 A | * | 10/1977 | Williams | 241/48 |
| 4,061,274 A | * | 12/1977 | Williams | 241/24 |
| 4,131,239 A | | 12/1978 | Stephanhoff | |
| 4,187,615 A | | 2/1980 | Iwata | |
| 4,219,164 A | | 8/1980 | Taylor | |
| 4,236,321 A | | 12/1980 | Palmonari et al. | |
| 4,259,401 A | * | 3/1981 | Chahroudi et al. | 428/306 |
| 4,391,411 A | | 7/1983 | Colburn | |
| 4,394,132 A | * | 7/1983 | Taylor | 44/51 |
| 4,532,155 A | | 7/1985 | Golant et al. | |
| 4,538,764 A | | 9/1985 | Dunbar | |
| 4,582,264 A | * | 4/1986 | Stephanoff et al. | 241/48 |
| 4,756,093 A | | 7/1988 | Heinemann et al. | |
| 4,819,884 A | | 4/1989 | Wiley | |
| 4,819,885 A | | 4/1989 | Wiley | |
| 4,824,031 A | | 4/1989 | Wiley | |
| 4,892,261 A | | 1/1990 | Rolle et al. | |
| 4,923,124 A | | 5/1990 | Wiley | |
| 5,096,744 A | | 3/1992 | Takei et al. | |
| 5,236,132 A | * | 8/1993 | Rowley, Jr. | 241/5 |
| 5,346,141 A | | 9/1994 | Kim et al. | |
| 5,598,979 A | * | 2/1997 | Rowley, Jr. | 241/5 |
| 5,611,882 A | * | 3/1997 | Reibel et al. | 156/272.2 |

* cited by examiner

*Primary Examiner*—Allen Ostrager
*Assistant Examiner*—William Hong
(74) *Attorney, Agent, or Firm*—Joseph T Regard Ltd

(57) ABSTRACT

A method and apparatus for comminuting and drying material utilizing a closed-loop cyclonic system including a cyclonic comminution chamber, and further incorporating heated or dried air for desiccation of the material, as well as reducing the air pressure of the system to provide enhanced drying of the material. The present invention further contemplates to a cyclonic mill system configured to fiberize and dewater cellulose and other materials in a highly efficient and cost effective manner. The present system employs indirect heat drying and fiberizing for the continuous drying and processing of moist cellulose (i.e., paper) material by cyclonically agitating same in a hot air flow via a specially designed cyclonic mill, which is configured to effectively dewater and decimate wet cellulose material from a variety of sources for form fiberized cellulose material suitable for thermal insulation. The present system contemplates a closed air cycle, recycling the heated air flow for energy conservation, while removing moisture and dust from same.

2 Claims, 6 Drawing Sheets

APPLYING FIRE RETARDANT MATERIAL
TO WASTE PAPER

↓

DEWATERING WASTE PAPER INFUSED WITH
FIRE RETARDANT MATERIAL TO 30-60% SOLIDS

↓

GRADUALLY LOADING DEWATERED WASTE PAPER
INFUSED WITH FIRE RETARDANT MATERIAL
INTO CYCLONIC MILL VIA HEATED, HIGH VELOCITY
AIR STREAM

↓

FIBERIZING AND DRYING VIA CYCLONIC MILL

↓

SEPARATING PROCESSED PRODUCT
FROM AIR STREAM

↓

SEPARATING DUST AND MOIST AIR FROM
AIR STREAM

↓

REINTRODUCING AIR STREAM INTO PROCESS, WHILE
REPLENISHING WITH HEATED AIR

FIGURE 5

GRADUALLY LOADING DEWATERED WASTE PAPER INFUSED WITH FIRE RETARDANT MATERIAL INTO CYCLONIC MILL VIA HEATED, HIGH VELOCITY AIR STREAM

↓

ALLOWING THE CYCLONIC AIR STREAM TO PLACE THE TREATED MATERIAL UNDER TENSION, FRACTURING THE MATERIAL ALONG LINES OF WEAKNESS

↓

EXPOSING THE FRACTURED MATERIAL TO LOW ATMOSPHERIC PRESSURE FORMED IN THE CYCLONIC AIR MASS, FACILITATING FURTHER EVAPORATIVE DRYING

↓

EJECTING THE FRACTURED, DRIED MATERIAL FROM THE CYCLONIC MILL

FIGURE 6

CLOSED-LOOP CYCLONIC MILL, AND METHOD AND APPARATUS FOR FIBERIZING MATERIAL UTILIZING SAME

STATEMENT OF CONTINUING APPLICATION

The present application is a continuation in part of U.S. patent application Ser. No. 09/099,925 filed Jun. 19, 1998 listing Harris J. Ribardi as the Inventor, entitled "CLOSED LOOP CYCLONIC MILL, AND METHOD AND APPARATUS FOR DRYING AND FIBERIZING WASTE PAPER TO FORM FIRE RETARDANT INSULATION".

TECHNICAL FIELD OF THE INVENTION

This invention relates to a method and apparatus for comminuting and drying material utilizing a closed-loop cyclonic system including a cyclonic comminution chamber, and further incorporating heated or dried air for desiccation of the material, as well as reducing the air pressure of the system to provide enhanced drying of the material. The present invention further contemplates to a cyclonic mill system configured to fiberize and dewater cellulose and other materials in a highly efficient and cost effective manner.

The present system employs indirect heat drying and fiberizing for the continuous drying and processing of moist cellulose (i.e., paper) material by cyclonically agitating same in a hot air flow via a specially designed cyclonic mill, which is configured to effectively dewater and decimate wet cellulose material from a variety of sources for form fiberized cellulose material suitable for thermal insulation. The present system contemplates a closed air cycle, recycling the heated air flow for energy conservation, while removing moisture and dust from same.

BACKGROUND OF THE INVENTION

Although the cyclonic mill has been known and utilized in a variety of applications over the years, none of the prior art references found taught or suggested the system of the present invention. Further, prior art processes for the manufacture of cellulose insulation have proven to be highly energy intensive, dusty, and overall inefficient in practice.

Patents which may have some relevance to the general operative characteristics of cyclonic mills and the like may include:

| Patent Number | Inventor(s) | Date of Issue |
|---|---|---|
| 1575717 | Plauson | 03/09/1926 |
| 1830174 | Peebles | 11/03/1931 |
| 3255793 | Clute | 06/14/1966 |
| 3800429 | Lindl | 04/02/1974 |
| 3937405 | Stephanoff | 02/10/1976 |
| 4187615 | Iwata | 02/12/1980 |
| 4236321 | Palmonari et al | 12/02/1980 |
| 4390131 | Pickrel | 06/28/1983 |
| 4391411 | Colbum | 07/05/1983 |
| 4756093 | Heinemann et al | 07/12/1988 |
| 4892261 | Rolle | 01/09/1990 |
| 5074476 | Mund | 12/24/1991 |
| 5096744 | Takei et al | 03/17/1992 |
| 5421524 | Haddow | 06/06/1995 |
| 5598979 | Rowley, Jr. | 02/04/1997 |

The above patents can be categorized as 1) vacuum cominutors; 2) cyclonic dryers utilizing heated or dried air; 3) cyclonic material treatment processes; and 4) general interest patents on cyclone systems and related technologies.

U.S. Pat. Nos. 1,575,717, 4,892,261, 4,391,411, 3,255,793 and 5,421,524 contemplate the utilization of a possible vacuum in cyclonic systems for enhanced disintegration.

U.S. Pat. Nos. 4,236,321, 3,800,429, 1,830,174, 5,096,744, 4,756,093, 5,598,979 contemplate cyclonic dryers utilizing possibly heated or dried air. Note that '979 further discusses the implementation of an "airlock" to further processing of the material.

U.S. Pat. No. 5,074,476, entitled "Method of manufacturing Fiber Material Containing Lignocellulose for the Production of Fiber boards", contemplates a cyclonic material treatment process which may have some pertinence to the present cellulose treatment. U.S. Pat. No. 4,187,615 is cited as of interest in that it incorporates a corona field in the treatment stream, which may be of use in the future for your system in some applications. U.S. Pat. No. 3,937,405 is of general pertinence teaching a cyclonic system for finely grinding powder.

The remaining patents above are cited for general information purposes, teaching cyclonic systems and related technologies.

Production of cellulose insulation products is not new, and is discussed in U.S. Pat. No. 4,168,175 to Shutt and U.S. Pat. No. 4,595,414 to Shutt and U.S. Pat. No. 5,534,301 to Shutt, which are further mentioned herein for reference.

In the prior art processes involving all-liquid fire retardant and drying chamber systems, which are entirely free of any fire retardants in a powder (dry) form, see U.S. Pat. No. 5,534,301 to Shutt. A supply of cellulose "paper" (preferably "grade 8" newspaper) is selected. The paper materials (i.e., recycled newspaper) are loaded into one or more conventional shredding and/or grinding systems to produce pieces of paper having a average width of about 2–6 in. and an average length of about 2–6 in. These numerical values are preferred for use in the claimed process.

The pieces of paper are transferred into a conventional spraying apparatus in which a liquid fire retardant is applied to the paper. As a result, fire retardant soaked paper product is generated. The product is then transferred into air that is heated to a temperature of about 300–350 deg. F at a flow rate of 2500–3500 feet/minute designed to simultaneously move paper product within chambers controlled with baffles to delay the paper product in the chambers to sustain a level of air flow or contact time with the paper product. The dried paper material is further processed to achieve additional size reduction. Size reduction is accomplished using one or more hammer mills or fiberizer systems known in the art for this product. The completed insulation product is then packaged and sold.

Another concept in drying of moist product is represented in U.S. Pat No. 3,592,395 to R. M. Lockwood wherein a fluidized bed dryer is provided to stir and dehydrate the product by motion of air through the product and in conjunction with a rotary agitator to stir the product.

Another drying apparatus for this type of material is shown in U.S. Pat No. 4,070,765 to S. Hovmand et al wherein a pneumatic conveyor dryer is used in the drying. This apparatus also includes recycling a portion of the dried material.

The deficiencies in the prior art equipment and processes involving drying cellulose insulation product lie in the need for continuous drying and the dust removal aspect "not making more dust". While the above noted processes could possibly be used to dry cellulose insulation product, they would be inefficient in that, after drying the fire retardant soaked paper product, the dry paper material would have to be further processed to achieve an approved level of smolder resistance, radiant panel, settle density, blown density, dust level and R-value.

In the prior art processes involving dry powder fire retardant system, a supply of cellulose "paper" (preferably "grade 8" newspaper) is selected. The paper materials (i.e. recycled newspaper) are then loaded into one or more conventional mechanical devices such as hammer mill systems known in the art to produce a pulverized product that is then sent to a fiberizer to produce a finely divided cellulose insulation product which maybe blended with a dry powder fire retardant to produce the completed product. The completed insulation product is then packaged and sold.

The deficiencies in the prior art equipment and processes using a dry powder fire retardant system are (a) the paper materials selected have to be dry and of a good quality and thereby expensive and selective (i.e., recycled newspaper preferably "grade 8" newspaper); these types of processes are sensitive to moisture; (b) they require the use of expensive, energy intensive additional devices such as hammer mill systems; (c) they further require the use of a fiberizer to produce a finely divided cellulose insulation product to add the selected dry powder fire retardant; (d) the need to use large amounts of dry fire retardants due to production with powder-type systems; e) Increase cost associated with the need to use large amounts of powder chemicals; (f) high amount of dust associated with dry powder systems.

This type of multi-stage size reduction by grinding or other conventional means requires high energy consumption and equipment which requires high maintenance and excessive down time.

GENERAL SUMMARY DISCUSSION OF THE INVENTION

Unlike the prior art, the present invention contemplates a relatively easily implemented, energy efficient and cost effective indirect heat drying and fiberizing system for the continuous drying of moist cellulose (i.e., paper) material by cyclonic agitation in a hot air flow, utilizing hot air being recycled with moisture and dust removed from the recycled air, providing substantially dry cellulose insulation without further processing.

The raw materials used to produce cellulose insulation by the present invention is much more diverse than prior art processes, including, for example, waste paper such as grade 8 newspaper, grade 6 newspaper, undeliverable mail, waste cardboard, and mix office waste that has been washed, soaked or sprayed with a liquid fire retardant then mechanically dewatered to 35 to 50% solids.

These materials are processed to produce a fiber material having a low bulk density and to meet an approved level of smolder resistance, radiant panel, settle density, blown density and R-value. Additional information regarding the production of cellulose insulation products are discussed in U.S. Pat. No. 4,168,175 to Shutt and U.S. Pat. No. 4,595,414 to Shuft and U.S. Pat. No. 5,534,301 to Shuft, the contents of which are incorporated herein for reference.

In the preferred embodiment of the present invention, indirect hot air is provided and a blower is connected tangentially to a double conical chamber through a nozzle, producing a cyclonic flow of high velocity air, such that the high velocity of the material entering the conical chambers is placed under tension and tends to fracture along areas of weakness such as boundary layers (fiberization) and the larger heavier particles are forced to the outer layers and the lighter or dryer particles are forced to the middle and down the wall of the conical chambers into a lower pressure area (vacuum) at the appropriate speed so that, with the abrupt change in pressure, the material is suddenly reversed upwards.

The average velocity determines the rate of evaporation since the transfer of heat to the surface depends on velocity. The heat transfer coefficient varies with velocity, and is a measure of resistance per unit area, as in the resistance to the flow of heat through a thin layer of the surface.

The present invention involves the mixing, agitating and separating of the material in thin layers (fiberizing), in a cyclonic hot air flow that is below atmospheric pressure while regulating the flow of moist material and the moisture removal from the air in order to dehydrate the moist material to a dry and fiberized cellulose insulation product having less than about 10% percent moisture content by weight, and separating dried material from the air flow in a product separator and separating moisture and dust from a portion of the air stream in a waste product separator and recycling the remainder of the hot air into the conical chamber. Making a dry and fiberized cellulose insulation that will meet the approved level of smolder resistance, radiant panel, settle density, blown density and R-value.

The materials are carried from the conical chambers in the hot air flow and separated from the hot air flow in a cyclone separator The cyclone separator discharges dried material into a storage container for bagging. Hot air from the cyclone separator has a portion extracted for dust and moisture removal prior to being recycled into the conical chambers.

One object of this invention is to overcome the disadvantages of the prior art devices in drying moist particulate and in the product on of cellulose insulation.

Still another object of this invention is to provide a processing apparatus that will operate continuously to dry moist particulate that has a liquid fire retardant composition soaked, sprayed, or washed into the fiber in the process of making cellulose insulation.

Still another object of this invention is to provide a process apparatus which is capable of handling this moist fiber and pulverizing it into a finely divided insulation.

Still another object of this invention is to provide an apparatus which is capable of producing a less dusty cellulose insulation.

Still another object of this invention is to provide an apparatus which is more versatile than prior art in selecting and mixing of raw materials. Example: you would have to buy # 8 newspaper and in some cases you are paid to take the lower grades.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 5 is a flow chart setting forth the step-by-step methodology of an exemplary embodiment of the present invention.

FIG. 6 is a flow chart setting forth the sub-steps of processing the material within the cyclonic mill.

DETAILED DISCUSSION OF THE INVENTION

The preferred embodiment of the present invention contemplates a system for the processing of waste paper to produce cellulose insulation, including an inlet feeder, cyclonic drying and fiberization means in the form of a cyclonic mill and separation means in the form of a hot air and product separator 3 utilizing a cyclone, and hot air and dust separator utilizing a filter bag arrangement 4.

Figure 1:
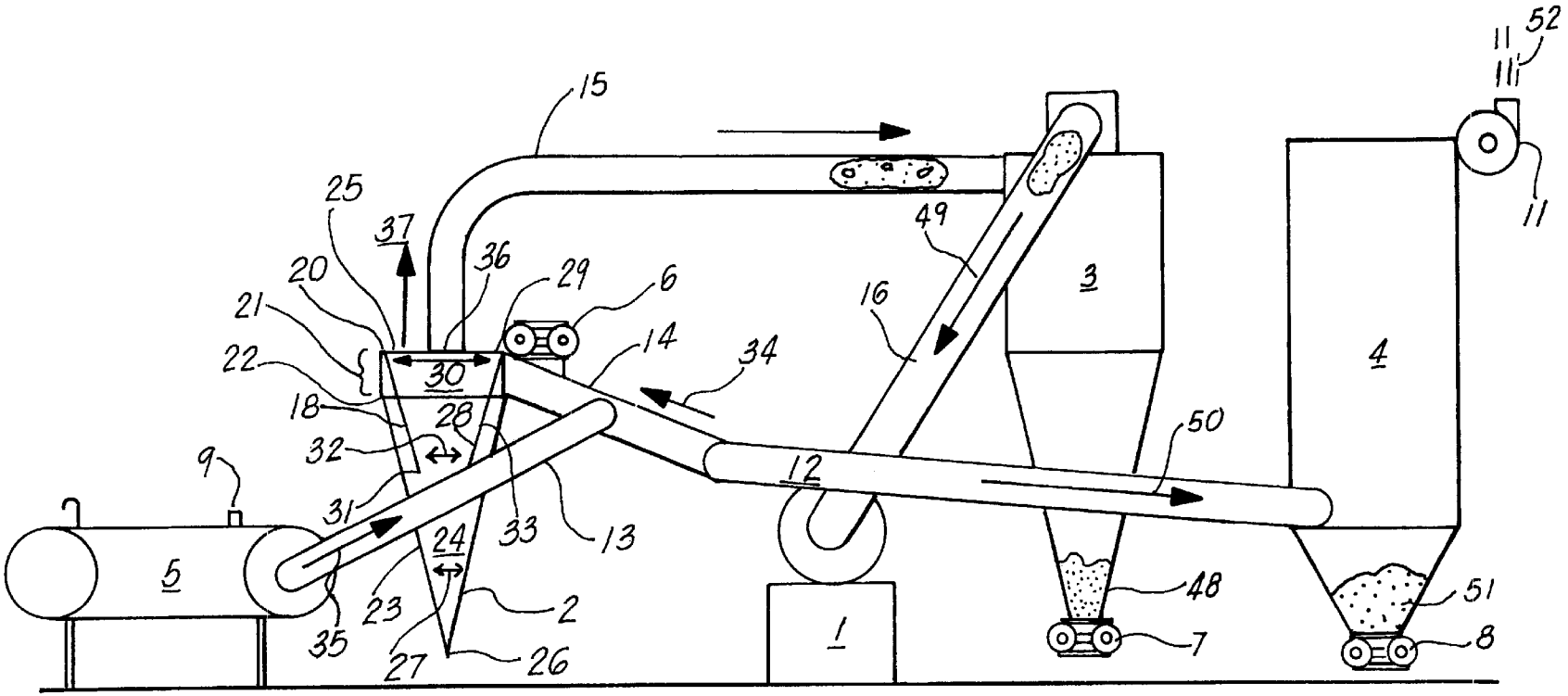
FIG. 1 illustrates the system of the present invention, illustrating generally the direction of air flow in the system between the various components.

Referring to FIG. 1, a comminution chamber 2 is configured to receive raw material from an inlet feeder 6, carried by closed-loop, a high velocity circulating air stream 34 supplemented by high velocity, heated air 35 from hot air source 5 having thermostat 9 via conduit 13.

Comminution chamber includes a top section 20 having generally cylindrically configured inner walls 21, which then taper 22 into generally conical inner walls 23 forming a cavity 24, the cavity 24 having upper 25 and lower ends 26, the upper end including cylindrical walls 21 having a diameter, then tapering to a lesser diameter 27 lower end. Emanating from the upper end of the cavity formed within the comminution chamber is conical projection 18 having tapered inner walls 28, and an upper end 29 having a larger diameter 30 tapering to a lower end 31 having a lesser diameter 32, forming a tapered conduit therebetween. In the preferred embodiment, the conical projection tapers 33 at about, for example, an eleven degree angle relative to the vertical.

Formed in the top of the chamber, situated within this tapered conduit, is the outflow port 36, which allows for outflow 37 of air and processed material.

Figure 2:
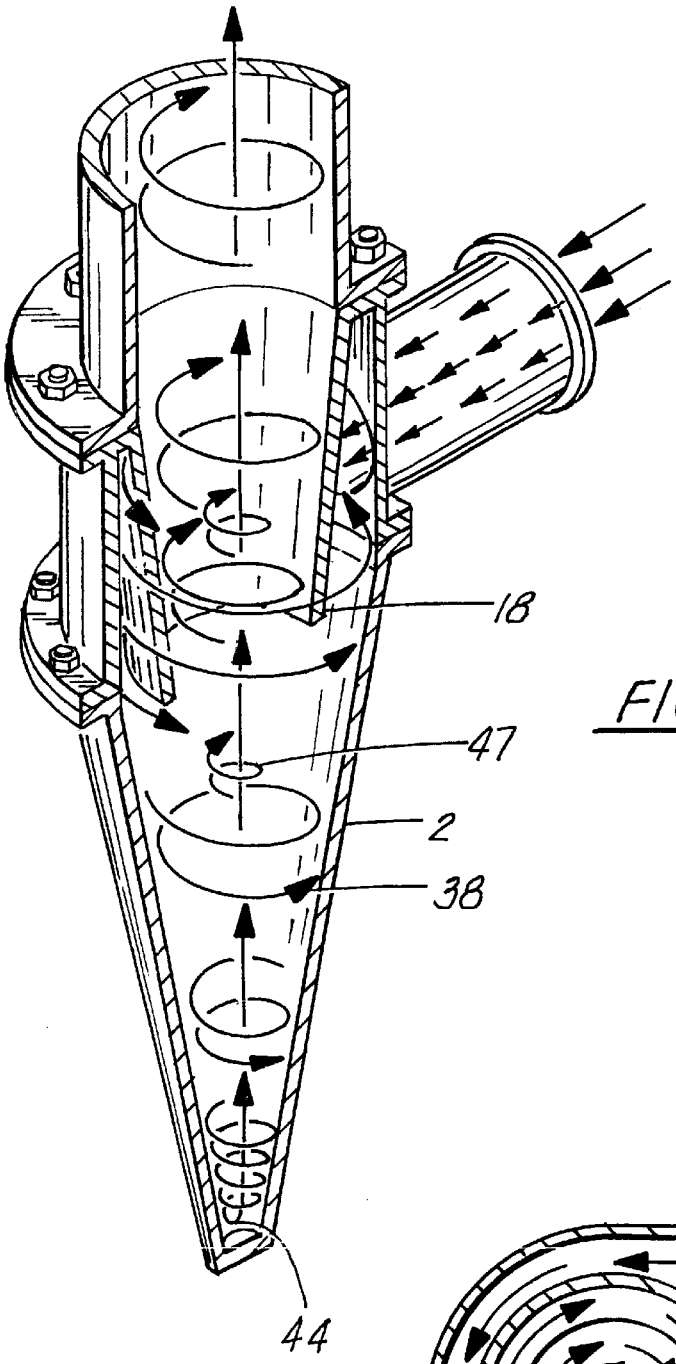
FIG. 2 is a side, partially cut-away view of the system of the cyclonic mill of the system of FIG. 1, illustrating an example of the cyclonic path which material must pass as it traverses this area.
Figure 3:
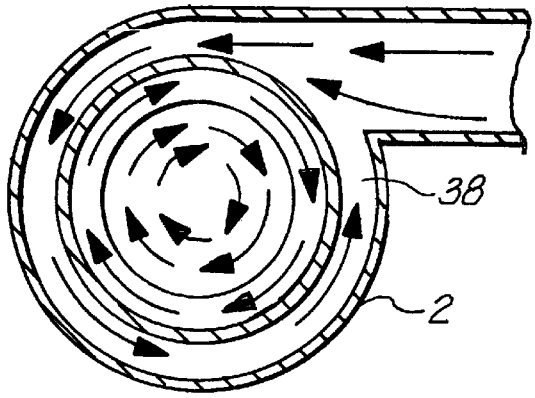
FIG. 3 is a top view of the cyclonic mill of FIG. 2, illustrating the circular path of the air which forms the cyclonic path.

Plenum 14 is connected tangentially to the cylindrical inner walls 21 formed in the comminution chamber 2 via inflow port formed through the cylindrical inner walls 21 at one end and to system blower 1 on the other end. Referring to FIGS. 2 and 3, a spiral flow of air is formed in the cylindrical chamber inducing a spiral flow in the conical chamber, producing pressures below atmospheric. As a result of this pressure differential in the comminution chamber 2, the drying and agitation of the material assists in the removal of moisture from the raw material, assisted by the reduced atmospheric pressure within the system. The assistance of the reduced pressure on drying and evaporation of materials is well known, thus it is important for comminution chamber 2 to be sealed to prevent degradation of the pressure differential and the entry of cool air into the system. This cone within a cone design, coupled with the position of the ingress and egress passages, forms the "cyclonic mill".

In the preferred embodiment of the present invention, the conical chamber 2 has an upper section having an outer diameter of about 15 inches, taper of about eleven degrees, although the system may work with a taper of about 9–15 degrees, and a longitudinal axis of measuring about 18" from top to bottom. The conical projection 18 has an exemplary length of about 18", a slope or taper of about eleven degrees, (but a nine to fifteen degree taper should work) a top separation or diameter of about 12 inches, and a bottom separation of about 8 inches. The inflow port measures about 26 square inches, having the configuration of a rectangle in the working embodiment, and the outflow port measures about twelve inches in diameter.

In use, waste paper such as grade 8 newspaper, grade 6 newspaper, undeliverable mail, waste cardboard, and mix office waste is washed, soaked or sprayed with a liquid fire retardant then mechanically dewatered to 35 to 50% solids. The material is then mixed and then introduced into the system via inlet feeder 6, where high velocity, dry air in plenum 14 forces the material into comminution chamber, cyclonically mixing the raw material and the heated air, and fiberizing the material.

Figure 4:
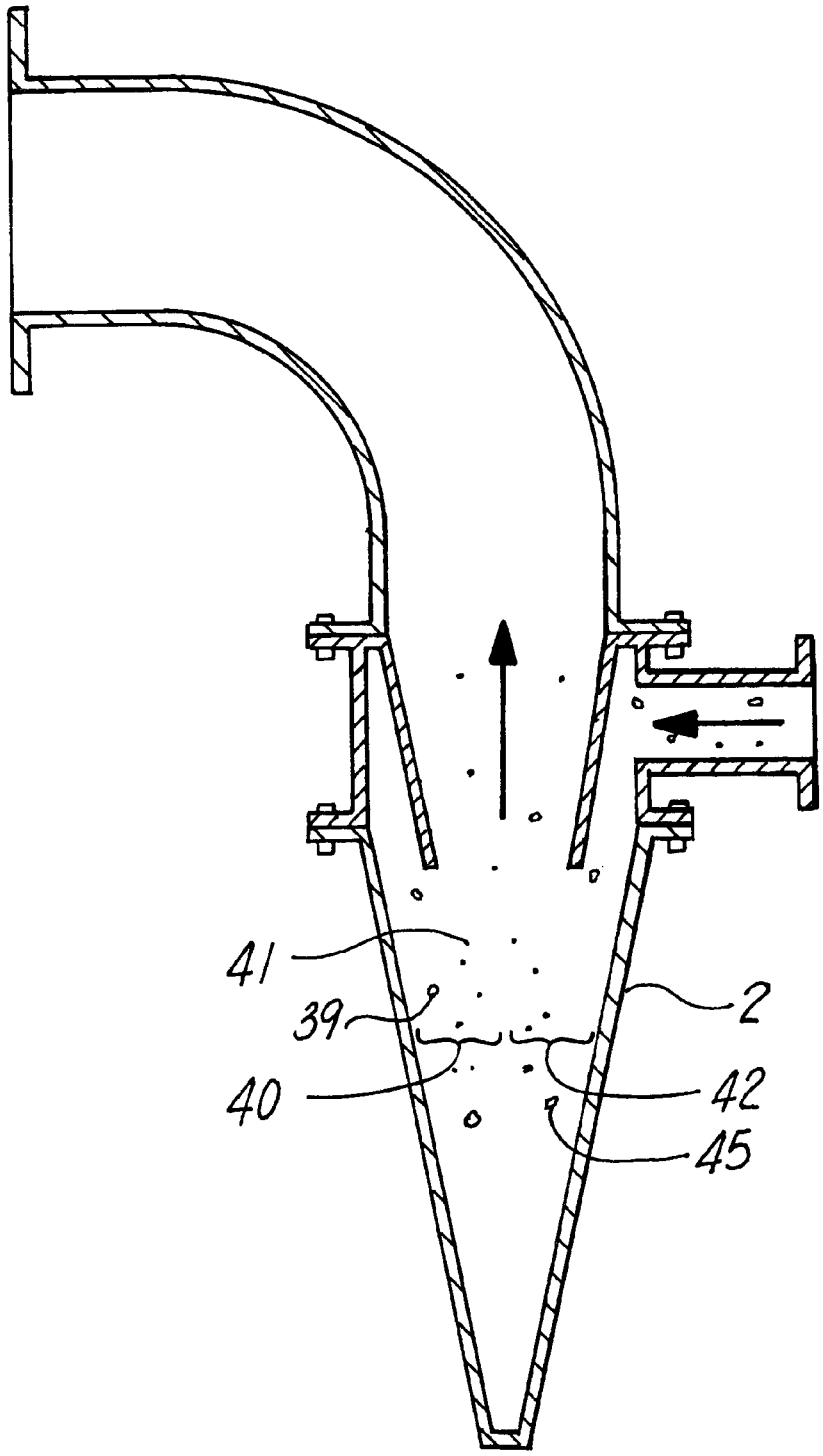
FIG. 4 is a side, cut-away view of the cyclonic mill of FIG. 2, illustrating material being processed within the mill, and the segregation of large and small bits of material therein.

Referring to FIGS. 2, 3, and 4, the high velocity of the air stream and material entering the comminution chamber, and the migration of same thereabout, places the material under tension, fracturing the material along areas of weakness, such as boundary layers, causing fiberization. The configuration of the chamber 2 causes the high velocity air mass with the material to engage in a cyclonic action 38, which forces the the larger or heavier particles 39 to the outer layers 40 of the chamber, with the lighter or dryer particles 41 being forced to a lower pressure middle 42, the material migrating in a circular, downward path generally along the wall of the conical chambers into a lower pressure area 44 (vacuum) (which is formed at the appropriate speed) so that, with the abrupt change in pressure, the material 45 entering the lower pressure area is suddenly reversed, and urged upwards through the conical projection 18. The average velocity determines the rate of evaporation since the transfer of heat to the surface depends on velocity. The heat transfer coefficient varies with velocity, and is a measure of resistance per unit area, as in the resistance to the flow of heat through a thin layer of the surface.

Returning to FIG. 1, the material is then passed by the hot air flow through the top of comminution chamber 2 via outflow port 36, the outflow 37 passing through to the product separator 3 via conduit 15 where a cyclone separation or other method is employed to remove the processed, dried material 48, and discharge same into storage by rotor vane valve 7. Return hot air 49 and dust is then recycled by system blower 1 through conduit 16 connected to product separator 3 and inlet of system blower 1. A portion of the recycled hot air 50 is extracted through conduit 12 and passed through a dust and moisture separator 4. The dust is discharged at rotary valve 8. Exhaust fan 11 exerts a negative air flow away from the system via conduit 12, pulling about ½ cubic feet/minute of the main blower, so as to facilitate removal of the moisture, while the material blows by conduit 12 due to the higher mass of the material. Further, this negative air flow facilitates introduction of heated air from hot air source 5 into the system.

The principal advantages of the present invention are providing a closed-loop system for comminuting and dehydrating materials while controlling emissions. Providing such a systems that processes a wide variety of materials. Providing a systems that is unlike prior art (Rowley, Jr.) is truly a closed-loop negative system with blower 1 FIG. 1 for the circulating and process air and blower two (2) to keep a negative on the system: Example: Air starts to move at blower 1 through conduit 14 mix with material in conduit 14 enter comminution chamber 2 material exits comminution chamber 2 through 36 then conduit 15 to separator 3 conduit 16 back to blower 1 intake. Blower 2 FIG. 9 is controlled by a motor controller to keep a negative on the system at all times by pulling air from conduit 12 to dust separator 4 and exhaust clean moist air at 11.

Rowley, Jr. U.S. Pat. No. 5,598,979 is a one pressure blower system his words providing such a system which, excepting a single blower and a material feeder, the reason that he needs this type of feeder is his system is under pressure, his closed loop system is a closed material collection chamber and it may be regulated to equalize the pressure in the chamber. His FIG. 9, 211 and 213, his whole system is under pressure at all times except his material collection.

We have a negative in the same area (his material feeder) we use a standard air lock feeder valve to stop cold air from entering the system. We also suck in our make-up air through conduit 13 from air heater 5 FIG. 1 if our system wouldn't be at a negative of 5 inches water gauge the hot make-up air couldn't enter the system.

Referring to FIG. 5, in summary, the general operation of the system is as follows:

APPLYING FIRE RETARDANT MATERIAL TO WASTE PAPER
↓
DEWATERING WASTE PAPER INFUSED WITH FIRE RETARDANT MATERIAL TO 30–60% SOLIDS
↓
GRADUALLY LOADING DEWATERED WASTE PAPER INFUSED WITH FIRE RETARDANT MATERIAL INTO CYCLONIC MILL VIA HEATED, HIGH VELOCITY AIR STREAM
↓
FIBERIZING AND DRYING VIA CYCLONIC MILL
↓
SEPARATING PROCESSED PRODUCT FROM AIR STREAM
↓
SEPARATING DUST 51 AND MOIST AIR 52 FROM AIR STREAM, and
↓
REINTRODUCING AIR STREAM INTO PROCESS, WHILE REPLENISHING WITH HEATED AIR.

Referring to FIG. 6, the treated material entering the cyclonic mill undergoes the sub-steps of:

GRADUALLY LOADING DEWATERED WASTE PAPER INFUSED WITH FIRE RETARDANT MATERIAL INTO CYCLONIC MILL VIA HEATED, HIGH VELOCITY AIR STREAM
↓
ALLOWING THE CYCLONIC AIR STREAM TO PLACE THE TREATED MATERIAL UNDER TENSION, FRACTURING THE MATERIAL ALONG LINES OF WEAKNESS
↓

-continued

EXPOSING THE FRACTURED MATERIAL TO LOW ATMOSPHERIC PRESSURE FORMED IN THE CYCLONIC AIR MASS, FACILITATING FURTHER EVAPORATIVE DRYING, and
↓
EJECTING THE FRACTURED, DRIED MATERIAL FROM THE CYCLONIC MILL.

PRACTICE OF THE INVENTION

One apparatus has been constructed to practice the system and the associated method of this invention. It had an air flow rate of 5000 CFM, and an operational range of at least 3,000–7,000 CFM. This system has achieved a flow rate of 3,100 pounds per hour of moist particulate that has a liquid fire retardant composition soaked, sprayed, or washed in to the fiber, having a moisture content of 60% by weight, processing same into about 1590 lbs of processed material. The air flow temperature in the comminution chamber 2 is 250 deg F., and should at least be 150–275 degrees Fahrenheit for optimal efficiency. It is estimated that material passing into the conical chamber experienced about a 15"–20" water gauge drop in pressure as it was fractured and fiberized due to the cyclonic action significantly aiding in the drying of same.

In working embodiment, the system blower (1) was a model 17AM by Chicago Fan, having 100 HP and further including a VeraDrive Electronic Controller. The material separator (3) was a common high efficiency design custom made by American Metal Fabricators, model 60, the dust separator (4) was a common bag house type, manufactured by the inventor of steel, utilizing a common size 88 bag, the rotor vane valves/rotary air locks (6, 7, 8) used in the preferred system were an eight inch size, model Cl manufactured by Donaldson of Dallas, Tex., the conduits being twelve to fourteen inches in diameter. The hot air source (5) was an RM 250 Natural Gas unit manufactured by Eclipse Combustion, of ILLINOIS having 2.5 million BTU Capacity, while the baghouse blower (11) was a 40 HP, model 15AM unit manufactured by Chicago Fan, 5000 CFM capacity.

Utilizing the above, the material fiberized to an ideal and unique consistency for cellulose thermal insulation, and was dried from the approximated 60% moisture content to a moisture content of about 10% by weight, at an overall operational cost well below the industry standard. It was found that the finished product met all the specifications for a process of making cellulose insulation, such as smolder resistance, radiant panel, settle density, blown density and R-value. The cellulose insulation made in this apparatus was bagged, and then blown into the attic of a home to check handling, blown density and dusting under actual working conditions, the insulation was installed by an expert in installing and handling cellulose insulation. The blown insulation provided a superior R-Value with less settling than did its commercial counterparts, all at a substantially less cost of production than prior art methods.

Figure 7A:
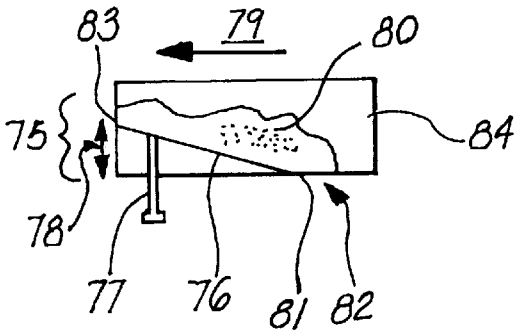
FIG. 7A is a top view of the nozzle of FIG. 7, illustrating an exemplary operation of same.
Figure 7B:
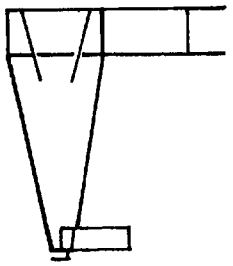
FIG. 7B is a side, partially cut-away view of the comminution chamber of the system of FIG. 7, illustrating the location of the adjustable passageway and nozzle.
Figure 7C:
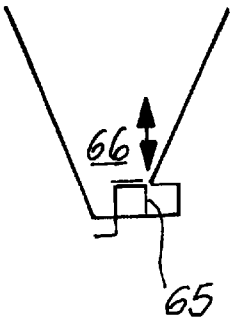
FIG. 7C is a side, close-up view of the adjustable passageway of the comminution chamber of FIG. 7.
Figure 7:
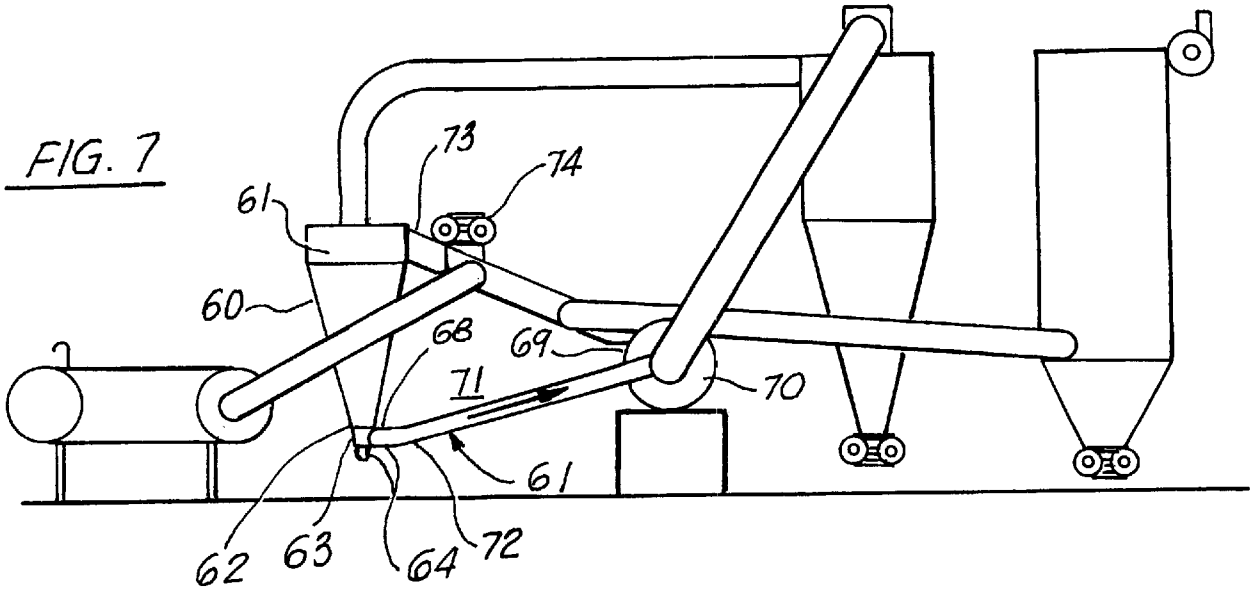
FIG. 7 illustrates an alternative embodiment of the invention of FIG. 1, wherein there is provided an adjustable passageway at the base of the comminution chamber, and a nozzle at the upper, mill end of the comminution chamber, for selectively adjusting the milling action of the system.

FIGS. 7–7C illustrate an alternative embodiment of the present system, wherein there is provided a communition chamber 60 having an upper, milling end 61 and a lower end 62, there being provided at the lower end an adjustable passageway 63 including a door 65 forming a portion of the inner wall of the comminution chamber, which door is adjustable 66 via lever 64 for selectively venting material into return conduit 67 having first 68 and second 69 ends, the first end 68 communicating with passageway 63, the second end 69 communicating with blower 70. This passageway allows the operator to selectively control the return 71 of material 72 of heavier density back to the milling portion of the comminution chamber, in order to increase efficiency of the operation of the system, and to better facilitate milling of certain materials.

Continuing with the drawings, the alternative embodiment further includes an adjustable nozzle 73 situated adjacent to the upper, milling portion 61 of the comminution chamber 60 within the conduit, the adjustable nozzle including an angled door 76 having first 81 and second 83 ends, the first end hingedly 82 connected to the plenum, the second end supported by an adjustable shaft 77, the exemplary shaft being threaded and being adjustable exterior the plenum via a knob or the like, the adjustable shaft varying the position and angle of the second end 83 of the door to facilitate an increase in the velocity 79 of the air stream varying 78 the size of the opening 75 of the plenum 84 adjacent to the upper, milling end of the comminution chamber, and consequent adjustment in material 80 speed within said air stream.

The operation of the system would be similar to that set forth in the discussion of the invention of FIGS. 1–6, except that the user now has the capability of selectively adjusting the return flow of larger density material into the loop via opening and adjusting the adjustable passageway 63, which may occur at selective times during the processing cycle. Further flexibility is provided in the adjustable nozzle, which the user may now selectively increase or decrease the velocity of material entering the upper, milling end of the comminution chamber, which adjustment may be made to facilitate milling of a wider variety of materials, or may be made while milling a particular material to enhance the milling cycle. The adjustable nozzle gives one the capability of adjusting the air and material velocity entering into the comminution chamber other then just changing the speed of the fan. Ideally, the angle of the nozzle (door 76) should not exceed 15 deg. as not to cause an air hammer in the conduit 84. This allows one to fine tune the air and material velocity entering into the comminution chamber, accomplishing a more consistent product.

The addition of the adjustable nozzle and adjustable passageway has been found to provide an increase in the been a real plus in the separation, fiberizing and drying a wide variety of materials. Tests have provided a cellulose insulation with a 1.4 pounds per sq foot density from a wet process which, according to the experts in this field, has been unachievable on a consistent basis heretofore.

Lastly, the present system allows for automated control of the flow of material and velocity of incoming material into the comminution chamber by providing feedback circuits in the form of moisture sensors, density sensors, pressure sensors, heat sensors, or motor draw (amperage) sensors, for selectively opening or closing the nozzle and adjustable passageway, or for providing a production cycle wherein the nozzle and adjustable passageway are adjusted during the production cycle, which may vary for different materials.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A method of drying and fiberizing waste paper to form fiberized, low bulk density thermal insulation, comprising the steps of:

a. providing a high efficiency system to process material into fiberized, low bulk density treated material, comprising:

a cyclonic mill, comprising a housing having a chamber formed therein, said chamber having a top, bottom and medial area therebetween as well as inner walls, said inner walls being cylindrical in the vicinity of the top of said chamber, inner walls having a taper from wide to narrow from said medial area to said bottom of said chamber, respectively, said cyclonic mill having an intake port for receiving an air stream having material suspended therein formed through said cylindrical, inner walls formed in said chamber, and an outflow port formed through said top of said chamber for exhausting said air stream having material suspended therein, so as to provide exhaust;

a product separator bin for receiving said exhaust from said outflow port of said cyclonic mill, said separator bin having a vent for venting separator exhaust, a system blower for providing an air stream, said system blower having a blower intake port for receiving said separator exhaust, said system blower for blowing said dust and air through a blower passage communicating with said intake port of said cyclonic mill;

a dust separator communicating with said blower passage, said dust separator having an exhaust fan to facilitate a negative air pressure, so as to draw dust flowing through said blower passage to said dust separator;

said system providing a closed-circuit flow of air and material through said cyclonic mill to said product separator to said system blower and back to said cyclonic mill, with said dust separator pulling dust from said blower passage while simultaneously providing reduced air pressure through the closed-circuit system, so as to facilitate enhanced evaporative dewatering and drying of material being processed by said system;

b. infusing said material with a fire retardant agent;

c. dewatering said waste paper to 30%–60% solids;

d. generating a cyclonic air stream in said cyclonic mill, said cyclonic air stream having an upper portion and a lower portion;

e. gradually loading material into said cyclonic air stream via said intake port of said cyclonic mill;

f. allowing said cyclonic air stream to place said material under tension, fracturing said material along lines of weakness, forming fractured, fiberized material;

g. exhausting said fractured, fiberized material in a flow of air from said cyclonic mill, providing cyclonic exhaust;

h. directing said cyclonic exhaust to said product separation bin, separating material from said flow of air, said product separation bin venting said flow of air and dust;

i. directing said flow of air and said dust to said blower intake port, and blowing said air and dust through a blower passage communicating with said intake port of said cyclonic mill;

j. providing a closed-circuit flow of air and material through said cyclonic mill to said product separator to said system blower and back to said cyclonic mill, with said dust separator pulling dust from said blower passage while simultaneously providing reduced air pressure through the closed-circuit system, so as to facilitate enhanced evaporative dewatering and drying of material being processed by said system.

2. A method of fiberizing material, comprising the steps of:

a. providing a high efficiency system to process material into fiberized, low bulk density treated material, comprising:

a cyclonic mill, comprising a housing having a chamber formed therein, said chamber having a top, bottom and medial area therebetween as well as inner walls, said inner walls being cylindrical in the vicinity of the top of said chamber, inner walls having a taper from wide to narrow from said medial area to said bottom of said chamber, respectively, said cyclonic mill having an intake port for receiving an air stream having material suspended therein formed through said cylindrical, inner walls formed in said chamber, and an outflow port formed through said top of said chamber for exhausting said air stream having material suspended therein, so as to provide exhaust;

a product separator bin for receiving said exhaust from said outflow port of said cyclonic mill, said separator bin having a vent for venting separator exhaust, a system blower for providing an air stream, said system blower having a blower intake port for receiving said separator exhaust, said system blower for blowing said dust and air through a blower passage communicating with said intake port of said cyclonic mill;

a dust separator communicating with said blower passage, said dust separator having an exhaust fan to facilitate a negative air pressure, so as to draw dust flowing through said blower passage to said dust separator;

said system providing a closed-circuit flow of air and material through said cyclonic mill to said product separator to said system blower and back to said cyclonic mill, with said dust separator pulling dust from said blower passage while simultaneously providing reduced air pressure through the closed-circuit system, so as to facilitate enhanced evaporative dewatering and drying of material being processed by said system;

b. generating a cyclonic air stream in said cyclonic mill, said cyclonic air stream having an upper portion and a lower portion;

c. gradually loading material into said cyclonic air stream via said intake port of said cyclonic mill;

d. allowing said cyclonic air stream to place said material under tension, fracturing said material along lines of weakness, forming fractured, fiberized material;

e. exhausting said fractured, fiberized material in a flow of air from said cyclonic mill, providing cyclonic exhaust;

f. directing said cyclonic exhaust to said product separation bin, separating said fractured, fiberized material from said flow of air, said product separation bin venting said flow of air and dust;

g. directing said flow of air and said dust to said blower intake port, and blowing said air and dust through a blower passage communicating with said intake port of said cyclonic mill;

h. providing a closed-circuit flow of air and material through said cyclonic mill to said product separator to said system blower and back to said cyclonic mill, with said dust separator pulling dust from said blower passage while simultaneously providing reduced air pressure through the closed-circuit system, so as to facilitate enhanced evaporative dewatering and drying of material being processed by said system.

* * * * *